US009681752B1

(12) United States Patent
Williams et al.

(10) Patent No.: US 9,681,752 B1
(45) Date of Patent: Jun. 20, 2017

(54) SYSTEM FOR DISABLING FURTHER MOVEMENT OF FURNITURE UPON DETECTING IMMINENT CONTACT BETWEEN THE FURNITURE AND AN OBJECT

(71) Applicants: James W. Williams, Mission Hill, SD (US); Mark W. Mauch, Yankton, SD (US)

(72) Inventors: James W. Williams, Mission Hill, SD (US); Mark W. Mauch, Yankton, SD (US)

( * ) Notice: Subject to any disclaimer, the term of this patent is extended or adjusted under 35 U.S.C. 154(b) by 0 days.

(21) Appl. No.: 14/626,995

(22) Filed: Feb. 20, 2015

(51) Int. Cl.
*A47C 7/62* (2006.01)
*A47C 1/024* (2006.01)

(52) U.S. Cl.
CPC ..... *A47C 7/62* (2013.01); *A47C 1/0242* (2013.01)

(58) Field of Classification Search
CPC ..... A47C 7/62; A47C 1/0242; A47C 16/005
USPC ..... 297/310, 217.3, 354.1, 362.11, 463.1, 297/463.2
See application file for complete search history.

(56) References Cited

U.S. PATENT DOCUMENTS 2,886,097 A 5/1959 Katz
4,016,613 A * 4/1977 Benoit ..... A47C 19/02 5/663
4,106,739 A 8/1978 Gasser
5,248,186 A 9/1993 Steinfeld
5,611,094 A * 3/1997 D'Entremont ..... A47C 19/02 248/345.1
7,287,817 B2 * 10/2007 Goldman ..... B60N 2/22 297/146
7,823,972 B2 * 11/2010 Browne ..... B60N 2/002 297/217.2
7,914,076 B2 * 3/2011 Broering ..... A61G 15/02 297/310
7,975,978 B2 * 7/2011 Ziaylek ..... B60R 7/043 248/154
8,042,868 B2 * 10/2011 Sakai ..... B60N 2/002 200/5 R
8,467,931 B2 6/2013 Inayoshi
8,702,173 B2 4/2014 Adams
8,727,437 B2 5/2014 Michalak
9,326,605 B2 * 5/2016 Schollmeyer ..... A47B 96/201
2003/0025370 A1 * 2/2003 Hensel ..... A47C 7/38 297/285
2004/0195895 A1 10/2004 Sedlatschek
2007/0188004 A1 8/2007 Browne
(Continued)

*Primary Examiner* — David R Dunn
*Assistant Examiner* — Tania Abraham
(74) *Attorney, Agent, or Firm* — Jeffrey A. Proehl; Woods, Fuller, Shultz & Smith, P.C.

(57) ABSTRACT

A system for minimizing damage to an object located rearward of a chair from rearward movement of a backrest portion of the chair by a powered movement apparatus, and the backrest portion may be movable rearwardly from a substantially upright position to a reclined position. The system may comprise an apparatus positionable on the backrest portion of the chair and configured to be triggered when the apparatus contacts an object positioned rearward of the backrest portion. The apparatus may be configured to be interfaced with the movement apparatus of the chair to interrupt rearward movement of the backrest portion when the apparatus is triggered.

15 Claims, 5 Drawing Sheets

(56) References Cited

U.S. PATENT DOCUMENTS

| | | | | |
|---|---|---|---|---|
| 2011/0272200 | A1* | 11/2011 | Clapp | A61G 1/017<br>180/54.1 |
| 2012/0086256 | A1 | 4/2012 | Adams | |
| 2012/0298113 | A1 | 11/2012 | Hruska | |

* cited by examiner

SYSTEM FOR DISABLING FURTHER MOVEMENT OF FURNITURE UPON DETECTING IMMINENT CONTACT BETWEEN THE FURNITURE AND AN OBJECT

BACKGROUND

Field

The present disclosure relates to furniture and more particularly pertains to a new system for disabling further movement of furniture upon detecting imminent contact between the furniture and an object for protecting that object, such as a wall, from damaging contact from the furniture.

SUMMARY

In one aspect, the present disclosure relates to a system for minimizing damage to an object located rearward of a chair from rearward movement of a backrest portion of the chair by a powered movement apparatus, with the backrest portion being movable rearwardly from a substantially upright position to a reclined position. The system may comprise an apparatus positionable on the backrest portion of the chair and configured to be triggered when the apparatus contacts an object positioned rearward of the backrest portion. The apparatus may be configured to be interfaced with the movement apparatus of the chair to interrupt rearward movement of the backrest portion when the apparatus is triggered.

In another aspect, the disclosure relates to a system comprising a chair having a seat portion and a backrest portion, with the backrest portion being reclinable with respect to the seat portion between an upright position and a reclined position. The chair may include a powered movement apparatus for moving the backrest portion between the upright and reclined position. The system may also comprise an apparatus for minimizing damage to an object located rearward of the chair from rearward movement of the backrest portion of the chair, with the apparatus being positioned on the backrest portion of the chair and configured to be triggered when the apparatus contacts the object positioned rearward of the backrest portion. The apparatus may be interfaced with the movement apparatus of the chair to interrupt rearward movement of the backrest portion when the apparatus is triggered.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
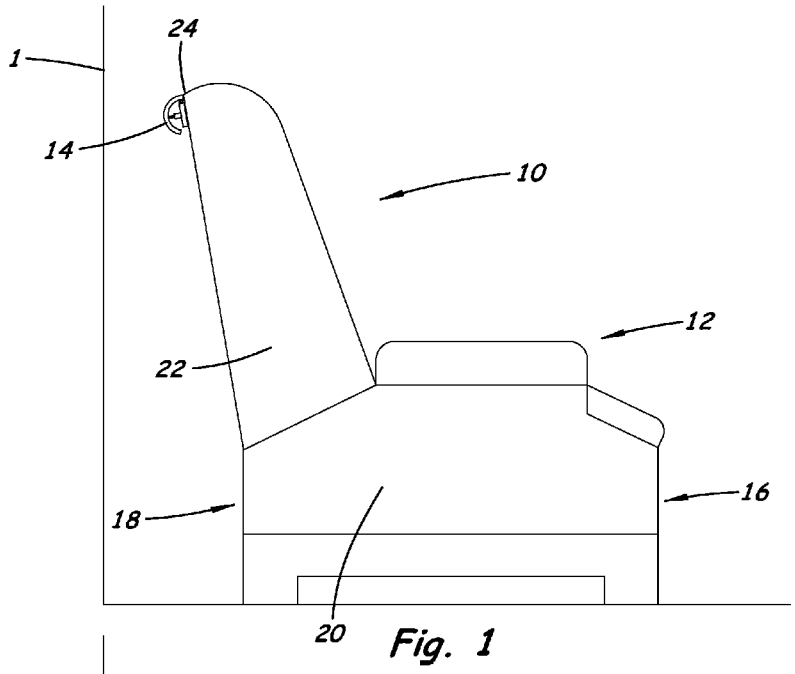
FIG. 1 is a schematic side view of a system with a chair and a new apparatus according to the present disclosure, with the backrest portion of chair being shown in the upright position.
Figure 2:
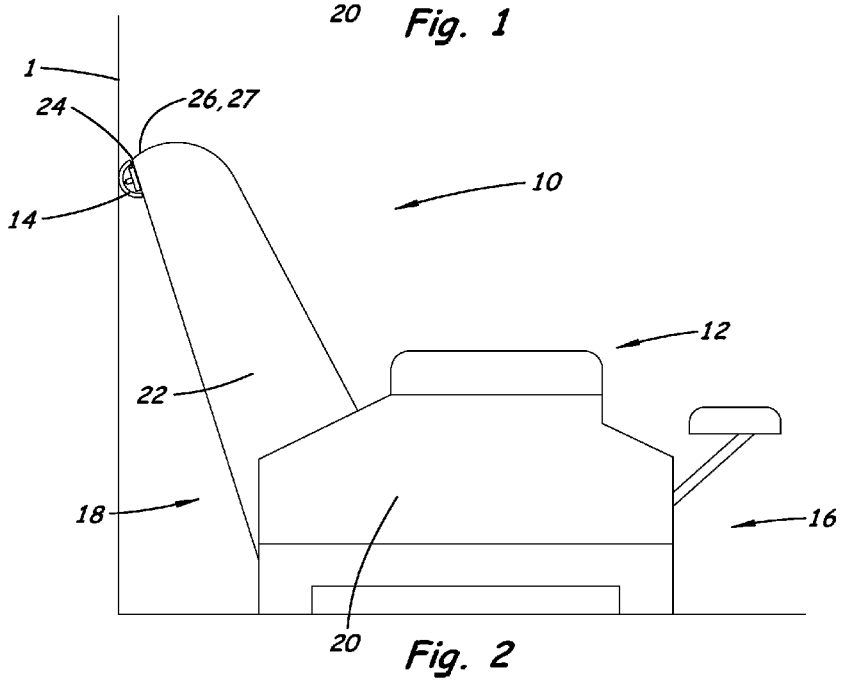
FIG. 2 is a schematic side view of the chair and apparatus according to the present disclosure, with the backrest portion of chair being shown in the reclined position.
Figure 3:
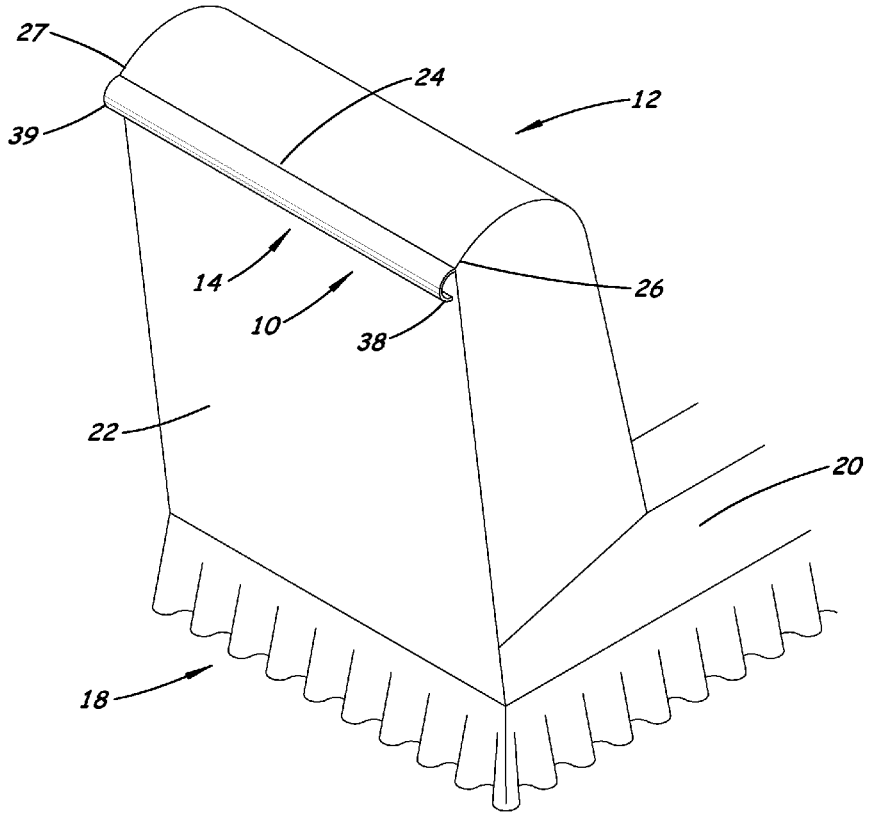
FIG. 3 is a schematic rear perspective view of the backrest portion of the chair with the apparatus located thereon, according to an illustrative embodiment.
Figure 4:
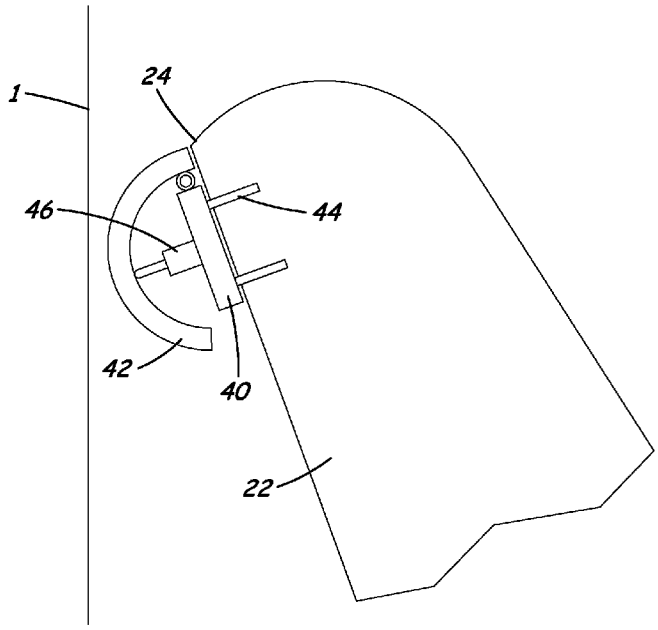
FIG. 4 is a schematic side view of a portion of the chair backrest in a partially reclined position prior to the apparatus being triggered, according to an illustrative embodiment.
Figure 5:
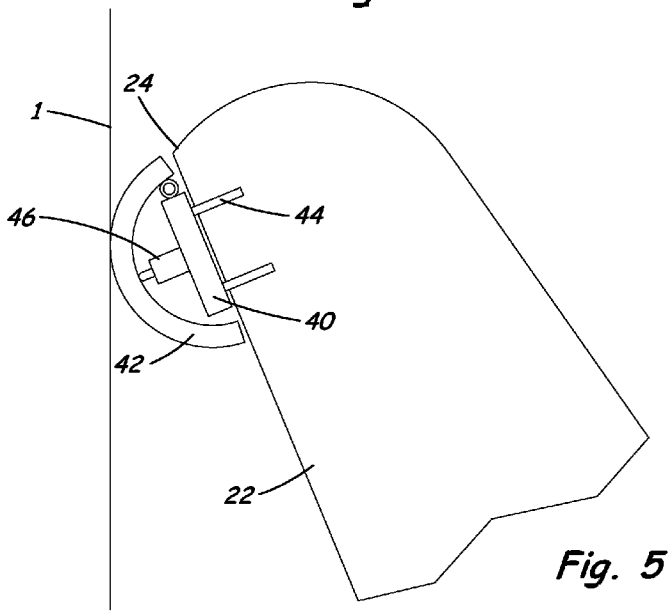
FIG. 5 is a schematic side view of a portion of the chair backrest in a more fully reclined position with the apparatus contacting the wall and being triggered, according to an illustrative embodiment.
Figure 6:
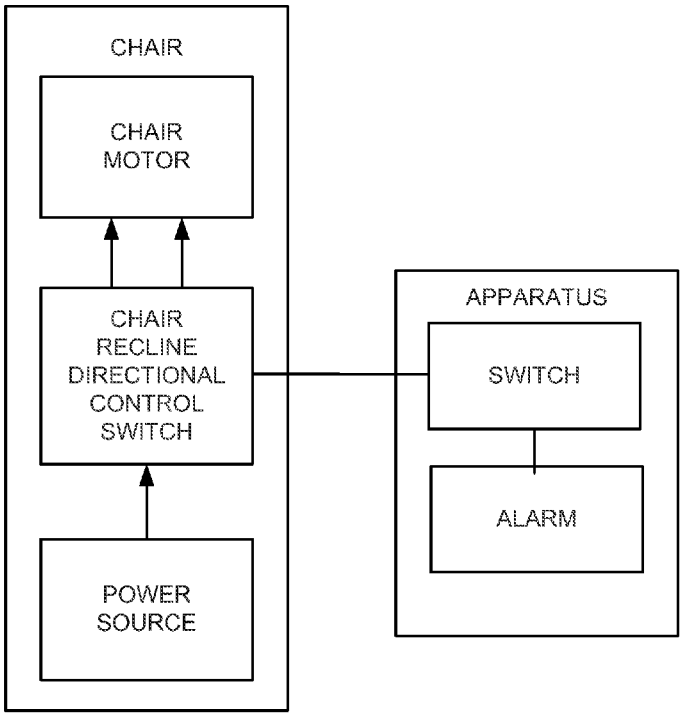
FIG. 6 is a schematic diagram of the system, according to an illustrative embodiment.
Figure 7:
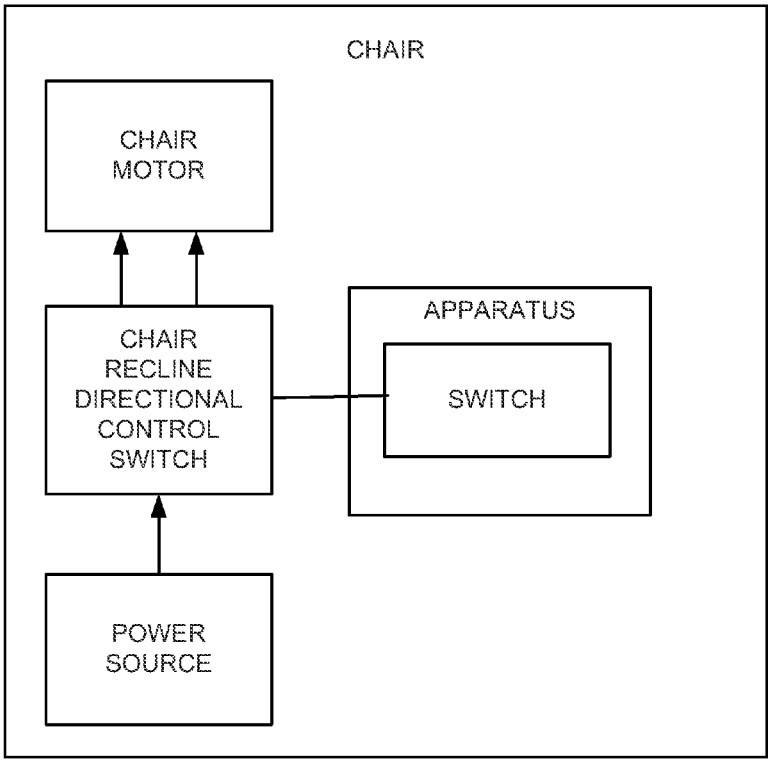
FIG. 7 is a schematic diagram of the system, according to an illustrative embodiment.

With reference now to the drawings, and in particular to FIGS. 1 through 7 thereof, a new system for disabling further movement of furniture upon detecting imminent contact between the furniture and an object embodying the principles and concepts of the disclosed subject matter will be described.

The use of chairs with reclining backrests provides a relaxing and comfortable experience for the user. This is especially true for the residents of care facilities who may have limited mobility. The limited strength and flexibility of some users make chairs with an automatic recline and return capability attractive for use, especially in those facilities serving the aged. However, the motorized movement of the backrest toward the inclined position, and the typical strength and relentless movement of the backrest can be damaging to objects that are located in the path of the reclining backrest. One typical "victim" of such movement is a wall located too close behind the chair, which is often constructed of wallboard formed of plaster that is rather brittle and not of sufficient strength to bear the pressure that can be exerted by the backrest. Often, if the backrest is not square or parallel with the wall surface, a corner of the backrest makes the initial contact with the wall surface and the pressure of the reclining backrest is concentrated in a small area, leading to a puncture of the wall board that may then be extended downwardly along the wall surface, especially if the user is unaware that the chair backrest is contacting the wall. These punctures, gouges and grooves in the wall are unsightly and require repair with a filler material or even a replacement piece of the wall board, and repainting of the affected area of the wall. Unfortunately, if the reclining chair is not maintained at a safe distance from the wall surface, the next use of the recline function of the chair is likely to result in repeated damage to the wall, and repeated repairs.

Applicant has recognized that a chair having the ability to detect imminent or initial contact between the reclining backrest and an object behind the chair would be advantageous, but also beneficial would be the combination of being able to detect the initial contact with the object and the ability to stop or discontinue the rearward reclining movement of the chair upon detection of contact. In some implementations, the discontinuance of rearward movement would not include disabling of forward movement of the backrest, so that the occupant of the chair would be able to return the chair to an un-reclined position and move the chair to a location sufficiently spaced from the wall surface before again attempting to recline the backrest. In some further implementations, the detection of initial contact with the wall surface may cause an automatic return of the backrest to an un-reclined position.

In one aspect, the disclosure relates to a system 10 that may comprise a chair 12 and an apparatus 14 for detecting the imminent or initial contact between the chair and an object rearward of the chair, such as a wall, when the chair is reclining, and may also limit the reclining movement of the chair to minimize damaging contact between the chair and wall. In some embodiments, the apparatus 14 may be integrated with the chair 12 so that the apparatus cannot be removed from the chair without damaging the chair, and the apparatus may be covered with the fabric or sheet material forming the outer upholstery of the chair. In other embodiments, the apparatus 14 may be retrofitted or added to a chair that does not have the apparatus incorporated into the chair. It should be recognized that although the term "chair" or "recliner" is used for describing illustrative embodiments of the disclosure, those skilled in the art will recognize that aspects of the system may be utilized on other items of furniture that have a reclining or moving part that may contact items such as walls outside of the immediate footprint of the item. Further, furniture that does not have moving parts, but may be moved wholly into contact with a wall, may be implemented with the apparatus to warn of impending contact.

Illustrative embodiments of the chair 12 have a front 16 and a rear 18 and may also have a seat portion 20 and a backrest portion 22. The seat portion 20 may be located toward the front 16 of the chair and the backrest portion 22 may be located toward the rear 18 of the chair. The backrest portion may be reclinable with respect to the seat portion, and may have a substantially upright position (see FIG. 1) and a substantially reclined position (see FIG. 2). The upright position may be characterized by the backrest portion being oriented in a substantially vertical orientation, and the reclined position may be characterized by the backrest portion being inclined rearwardly from the upright position at an angle of various degrees, with angled orientations approaching a horizontal orientation being possible with some chairs. The backrest portion moves rearwardly as it reclines so that the backrest extends rearwardly beyond its floor footprint to a degree that varies with the degree of inclination of the backrest portion. The backrest portion may have a top rear edge 24 which may terminate in opposite corners 26, 27 of the backrest portion. The top rear edge 24 may form the rearmost location on the chair in the reclined position of the backrest portion, and may also be the rearmost extent in the upright position for many chair designs. The top rear edge 24 moves rearwardly when the backrest portion moves from the upright position to the reclined position. Typically is the leading edge of the rearward movement of the backrest portion, and often one of the corners 26 or 27, will be the first part of the chair to contact a wall behind the chair during reclining movement.

The chair 12 may include a movement assembly 30 that is configured to move the backrest portion 22 between the upright position and the reclined position, and may do so in an automatic manner generally controlled by the occupant of the chair. The movement assembly 30 of the chair may include an electrical motor 32 operatively coupled to mechanical structure configured to move the backrest portion in a rearward direction and a forward direction. In some embodiments, the backrest may move in the rearward direction when the motor rotates in a first rotational direction and move the backrest portion in the forward direction when the motor rotates in a second rotational direction. Optionally, the mechanical structure may include screw and nut, rack and pinion, piston and cylinder, and the like. The movement assembly 30 may also include a movement control device or switch 34 that is configured to control the movement of the backrest portion 22, and the movement control device may control the supply of power to the electrical motor from a power source 36. The movement control device may be configured to control the rotational direction of the motor, such as be changing the polarity of power supplied to the motor.

The apparatus 14 may be configured to protect an object or wall behind the chair from damaging contact with the chair and may accomplish this through modifying the operation of the chair, such as by interrupting movement of the backrest portion in the rearward direction when the apparatus detects imminent or initial contact of the backrest portion with the wall behind the chair.

The apparatus 14 may be configured to be positioned on the backrest portion 22 of the chair at a location that is most likely to first contact an object such as a wall behind the backrest portion. Illustratively, the apparatus may achieve this by being positioned at or near the top rear edge 24 of the backrest portion of the chair, such as between the opposite corners 26, 27. The apparatus 14 may be elongated for extending along substantially the entire length of the top rear edge 24, with opposite ends 38, 39 that are positioned adjacent to the corners 26, 27 of the backrest portion. The apparatus may be relatively thin in overall width or thickness so as to minimize any significant rearward extension of the apparatus beyond the top rear edge, although some addition to this dimension of the chair by the apparatus may be necessary for suitable operation.

The apparatus 14 may be triggered by contact of the apparatus with a wall or object rearward of the chair, such as contact that tends to compress or squeeze or pinch the apparatus, such as between the backrest portion 22 and the vertical wall surface 1, which tends to apply force to the apparatus in a substantially transverse plane of the elongated apparatus. The contact may occur at any location along the length of the apparatus, and may often occur at one or the other ends 38, 39 of the apparatus although this is not necessarily the case.

The apparatus 14 may be configured to disable rearward movement of the backrest portion when the apparatus 14 is triggered, such as by contact with the wall. The disabling of rearward movement may be performed without disabling forward movement of the backrest portion, which allows the occupant to return the seat to its upright position without assistance and optionally reposition the chair with respect to the wall at a distance that will allow safe reclining movement without triggering the apparatus 14. Illustratively, when the apparatus 14 is triggered, the apparatus may be configured to stop operation of the movement assembly 30 of the chair and thereby stop the rearward movement. In some embodiments, when the apparatus is triggered, the apparatus may stop operation of the motor 32 of the movement apparatus at least in the operational direction that would cause further rearward movement of the backrest portion. Optionally, the apparatus 14 may include an alarm 48 or buzzer that sounds when the apparatus is triggered to indicate to the user that the apparatus has been triggered and that further rearward movement of the backrest portion may be disabled.

In some illustrative embodiments, the apparatus 14 may include a first element 40 and a second element 42. Looking first to the first element, the element 40 may be configured for relatively stationary mounting with respect to the backrest portion 22 of the chair. The first element 40 may also be elongated in shape for mounting along the top rear edge 24 of the backrest portion 22 of the chair.

The first element 40 may be mounted on the seatback portion of the chair, and in some embodiments may be integrated with the backrest portion of the chair, such as being mounted on the frame of the backrest portion of the chair which is especially suitable for applications in which the apparatus is integrated with the chair. In embodiments in which the apparatus 14 may be removable from the chair, the first element may be removably mountable on the back rest portion of the chair, such as on or over the upholstery of the chair. The first element 14 may include attachment structure 44 configured to removably attach the first element to the backrest portion of the chair. The attachment structure 44 may comprise fasteners that are suitable to attach to the upholstery, such as pins for cloth-type upholstery or adhesive for smooth sheet upholstery materials such as vinyl or leather. In other embodiments, the elements of the apparatus may be attached to a cover that fits over at least a portion of the backrest of the chair to maintain the apparatus in the proper and effective position.

The second element 42 of the apparatus 14 may be configured for movement free of the backrest portion of the chair, and may be movable with respect to the first element 40. The second element 42 may be movably mounted on the first element to permit movement of the second element with respect to the first element. In some embodiments, the second element may be pivotable with respect to the first element, and may be pivotally mounted on the first element. The second element 42 may be elongated in shape similar to the first element, and in some embodiments the lengths of the first and second elements may be substantially equal.

The apparatus 14 may further comprise a switch 46 that may be actuated by movement of the second element 42 with respect to the first element 40, such as would result from the second element contacting a relatively immovable surface as the apparatus moves rearwardly during recline movement of the backrest portion. The switch 46 may be connected to either or both of the first and second elements in a manner that the switch is actuated when the second element moves with respect to the first element. Illustratively, the switch 46 may be positioned between the first and second elements, such that movement of the second element toward the first element moves elements of the switch to cause actuation.

In some implementations, the switch 46 of the apparatus 14 may have an interface to the movement control device 34 of the chair that is configured to prevent further supply of power to the motor 32 by the switch when the switch is triggered by the second element. Such functionality may also be provided by embodiments in which the switch of the apparatus simply cuts off power to the chair itself, although such functionality not advantageous since it may leave the user of the chair stranded in the chair in an inclined position. In some further implementations, the interface between the apparatus switch 46 and the chair control switch 34 may also reverse the operation of the motor, such as by reversing the polarity of power flow from the control switch 34 to the motor, to move the backrest portion toward the upright position. In some configurations, continued actuation of the switch 34 after the apparatus 14 has been triggered may function to move the backrest in a forward direction.

It will be appreciated that in some embodiments of the apparatus 14 the first element might not be a separate and distinct part, such as in configurations where the apparatus is integrated into the chair and the chair frame forms the first element and the second element is mounted so as to be movable with respect to the chair frame. In such variations, the second element may be pivotally mounted on the chair frame and the switch may also be mounted on the frame such that the frame acts as the structure of the first element.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

We claim:

1. A system for minimizing damage to an object located rearward of a chair from rearward movement of a backrest portion of the chair by a powered movement apparatus, the backrest portion being movable rearwardly from a substantially upright position to a reclined position, the system comprising an apparatus positionable on the backrest portion of the chair and triggered by contact with an object positioned rearward of the backrest portion; and wherein the apparatus is interfaced with the movement apparatus of the chair to interrupt rearward movement of the backrest portion when the apparatus is triggered;

wherein the apparatus is configured to disable rearward movement of the backrest portion when the apparatus is triggered without disabling forward movement of the backrest portion.

2. The system of claim 1 wherein the apparatus is configured to be removably positioned on the backrest portion of the chair.

3. The system of claim 2 wherein the apparatus is configured to be positioned at a top rear edge of the backrest portion of the chair.

4. The system of claim 1 wherein the apparatus is elongated to extend substantially an entire length of a top rear edge of the backrest portion of the chair.

5. The system of claim 1 wherein the contact is pinching of the apparatus between the backrest portion of the chair and the object rearward of the backrest portion.

6. The system of claim 1 wherein when the apparatus is triggered, the device is configured to stop operation of a motor of the movement apparatus of the chair.

7. The system of claim 1 wherein the apparatus comprises a first element configured for stationary mounting with respect to the backrest portion of the chair;

a second element being movable with respect to the first element and the backrest portion of the chair; and a switch actuated by movement of the second element with respect to the first element.

8. A system comprising:

a chair having a seat portion and a backrest portion, the backrest portion being reclinable with respect to the seat portion between an upright position and a reclined position, the chair including a powered movement apparatus for moving the backrest portion between the upright and reclined position;

an apparatus for minimizing damage to an object located rearward of the chair from rearward movement of the backrest portion of the chair, the apparatus being positioned on the backrest portion of the chair and triggered by contact with the object positioned rearward of the backrest portion; and wherein the apparatus is interfaced with the movement apparatus of the chair to disable rearward movement of the backrest portion when the apparatus is triggered without disabling forward movement of the backrest portion.

9. The system of claim 8 wherein the apparatus is positioned at a top rear edge of the backrest portion of the chair.

10. The system of claim 8 wherein the apparatus is elongated to extend substantially an entire length of a top rear edge of the backrest portion of the chair.

11. The system of claim 8 wherein the contact is pinching of the apparatus between the backrest portion of the chair and the object rearward of the backrest portion.

12. The system of claim 8 wherein when the apparatus is triggered, the device is configured to stop operation of a motor of the movement apparatus of the chair.

13. The system of claim 8 wherein the apparatus comprises a first element configured for stationary mounting with respect to the backrest portion of the seat;

a second element being movable with respect to the first element and the backrest portion of the chair; and a switch actuated by movement of the second element with respect to the first element.

14. The system of claim 8 wherein the apparatus is removably mountable on the back rest portion of the chair.

15. The system of claim 14 wherein the apparatus includes attachment structure configured to removably attach a first element of the apparatus to the backrest portion of the chair.

* * * * *